US005794690A

United States Patent [19]

Kim et al.

[11] Patent Number: 5,794,690

[45] Date of Patent: Aug. 18, 1998

[54] HEAT EXCHANGER OF AIR CONDITIONER

[75] Inventors: Yeung-Saeng Kim, Inchon; Baek Youn, Suwon, both of Rep. of Korea

[73] Assignee: Samsung Electronics Co., Ltd., Suwon, Rep. of Korea

[21] Appl. No.: 600,500

[22] Filed: Feb. 13, 1996

[30] Foreign Application Priority Data

Feb. 15, 1995 [KR] Rep. of Korea ..... 95-2443

[51] Int. Cl.[6] ..... F28D 1/04

[52] U.S. Cl. ..... 165/151; 165/181

[58] Field of Search ..... 165/151, 181

[56] References Cited

U.S. PATENT DOCUMENTS

| | | | |
|---|---|---|---|
| 3,916,989 | 11/1975 | Harada et al. | 165/151 |
| 4,832,117 | 5/1989 | Kato et al. | 165/151 |
| 5,042,576 | 8/1991 | Broadbent | 165/151 |

FOREIGN PATENT DOCUMENTS

| | | | |
|---|---|---|---|
| 3406682 | 9/1985 | Germany | 165/151 |
| 0082690 | 5/1982 | Japan | 165/151 |
| 60-178293 | 9/1985 | Japan . | |
| 0006590 | 1/1986 | Japan | 165/151 |
| 2266391 | 11/1987 | Japan | 165/151 |
| 0183391 | 7/1988 | Japan | 165/151 |
| 0136696 | 5/1990 | Japan | 165/151 |

*Primary Examiner*—John Rivell
*Assistant Examiner*—Christopher Atkinson
*Attorney, Agent, or Firm*—Burns, Doane, Swecker & Mathis, L.L.P.

[57] ABSTRACT

A heat exchanger includes parallel fins mounted on heat-transfer pipes which project through the fins. Each fin includes groups of slits disposed between the pipes. Each group includes an upper tier of slits, and a lower tier of slits located below the upper tier. Each tier includes four slits arranged in a radiant (radial) relationship with respect to a respective pipe. Each slit has a cross section which becomes larger in a direction away from the respective pipe.

6 Claims, 4 Drawing Sheets

HEAT EXCHANGER OF AIR CONDITIONER

BACKGROUND OF THE INVENTION

1. Field of the Invention

The present invention relates to a heat exchanger of an air conditioner, and more particularly to a heat exchanger of an air conditioner comprising flat fins, heat exchanger pipes extending through the fins, and slits formed in the fins around each pipe to create turbulent flow.

2. Description of the Invention

Generally, a heat exchanger used for an air conditioner includes, as illustrated in FIG. 1, a plurality of flat fins arranged in parallel at a predetermined interval and a plurality of heat transfer pipes 2 disposed in perpendicular to the flat fins 1, and at the same time, arranged in zigzag patterns.

At this location, a fluid (by way of example, room air) flows through the plurality of flat fins 1 along an arrow head direction to thereby perform a heat-exchange with medium in the heat transfer pipes 2.

During travel of heat fluid around the flat fins 1 a heat transfer rate is markedly reduced as it goes from a tip end to a longitudinal end because a temperature boundary layer 3 (i.e., a layer where heat is not properly transmitted from the heat transfer pipe 2 disposed on a heat transfer surface of the flat fin 1) becomes thicker as it goes from the tip end of the flat fin 1, i.e, from left to right in FIG. 2.

Thus, there is a disadvantage of low performance as a heat exchanger.

Furthermore, during travel of heat fluid around the heat transfer pipe 2, as illustrated in FIG. 3, the heat is not properly transmitted beyond an angle 20 approximately 70 to 80 degrees when a fluid of low speed flows toward the heat transfer pipe 2 in an arrow head direction.

In other words, because there occurs an unavailable void 4 at in the rear of the heat transfer pipe 2, it is inevitable that efficiency of the heat exchanger is deteriorated.

Japanese laid open publication No. Sho 60-178293 is disclosed as a prior art, where, as illustrated in FIG. 4, a heat exchanger is so constructed as to have one-tier slit type grid 30 formed in a flat fin 32 in a radiant pattern, centering around a heat transfer pipe 31.

In this case, although there is an advantage in that an improved performance of heat exchange between medium in the heat transfer pipe 31 and fluid can be expected because the fluid is agitated to thereby become turbulent around the heat transfer pipe 31, there is still something to be desired in minimizing an available void generating in the rear side of the heat transfer pipe 31.

SUMMARY OF THE INVENTION

Accordingly, the present invention is disclosed to solve the aforementioned disadvantage and it is therefore an object of the present invention to provide a heat exchanger of an air conditioner by which fluid passing through respective flat fins is made turbulent and at the same time mixed, to thereby minimize a generating of unavailable void in the rear of the heat transfer pipes, so that heat exchange efficiency can be improved.

The heat exchanger of an air conditioner according to the present invention having a plurality of flat fins arranged in parallel at predetermined intervals so as to allow fluid to flow thereamong and a plurality of heat transfer pipes insertedly arranged in zigzag patterns up and down the plurality of the flat fins so as to allow a heat exchange to be realized between the fluid and medium therein, the heat exchanger comprising slit type grid groups formed at two lateral sides of the flat fins in order to form a broad sectional area at a portion from which the heat transfer pipes are distanced, and, at the same time, to allow same to form in radiant pattern around the heat transfer pipes, so that the fluid flowing through the plurality of flat fins can become turbulent and mixed around the heat transfer pipes.

BRIEF DESCRIPTION OF THE DRAWINGS

For a better understanding of the nature and objects of the invention, reference should be made to the following detailed description taken in conjunction with the accompanying drawings in which.

DETAILED DESCRIPTION OF A PREFERRED EMBODIMENT OF THE INVENTION

Now, the embodiment of the present invention will be described in detail with reference to the accompanying drawings.

Figure 1:
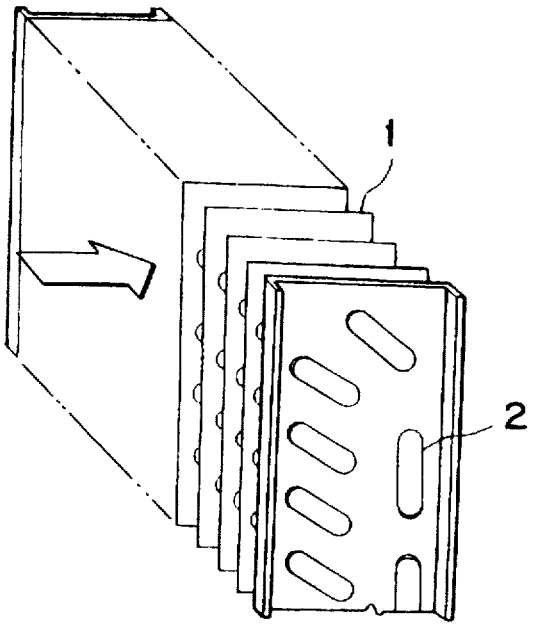
FIG. 1 (PRIOR ART)
FIG. 1 is a perspective view of a heat exchanger according to the prior art.
Figure 2:
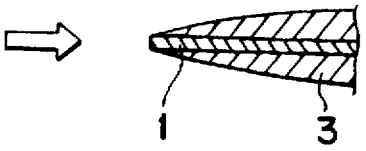
FIG. 2 (PRIOR ART)
FIG. 2 is a schematic drawing for describing heat fluid of the flat fin illustrated in FIG. 1.
Figure 3:
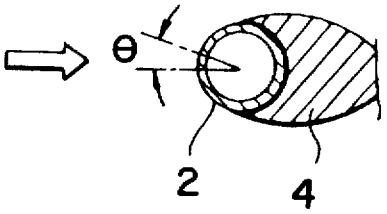
FIG. 3 (PRIOR ART)
FIG. 3 is a schematic drawing for describing the heat fluid around the heat transfer pipe illustrated in FIG. 1.
Figure 4:
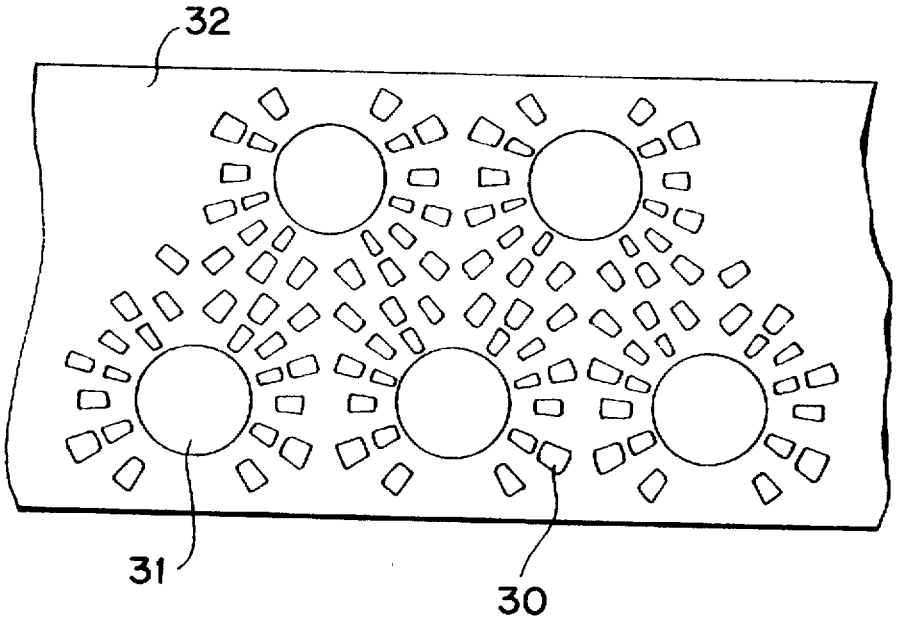
FIG. 4 (PRIOR ART)
FIG. 4 is a plan view for illustrating another heat exchanger according to the prior art.
Figure 5:
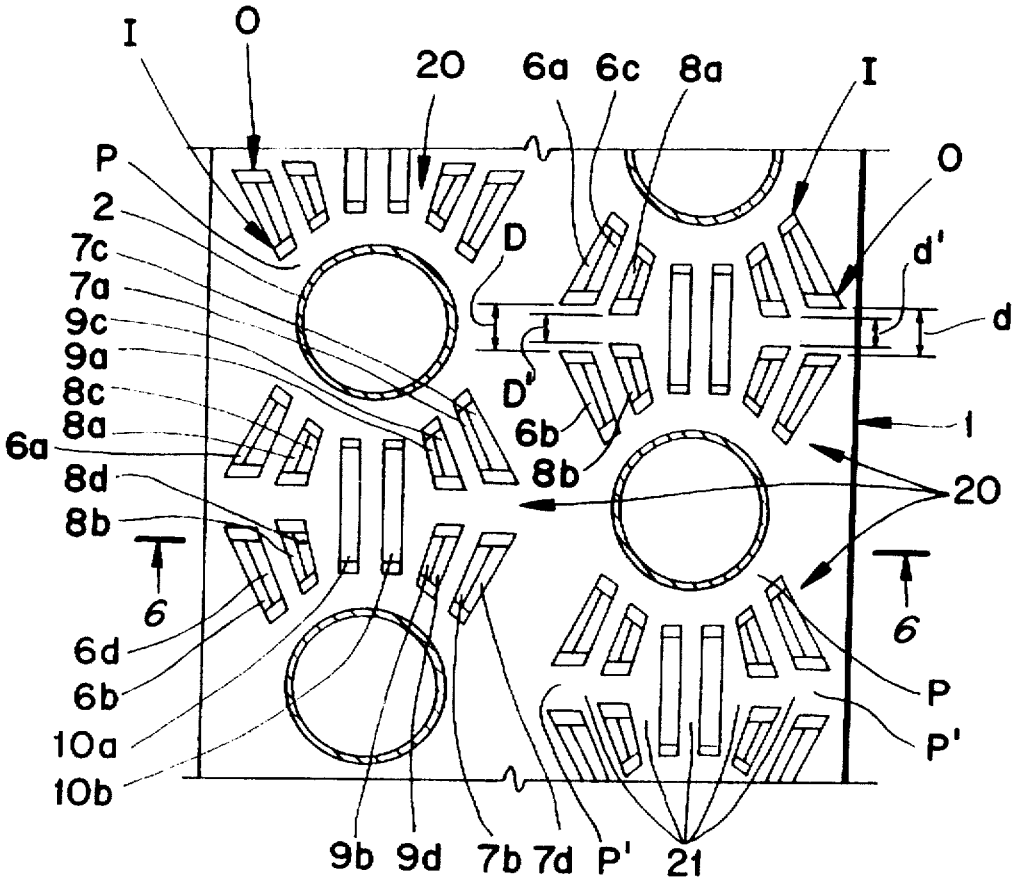
FIG. 5 is a plan view for illustrating a flat fin of a heat exchange according to the present invention.
Figure 6:
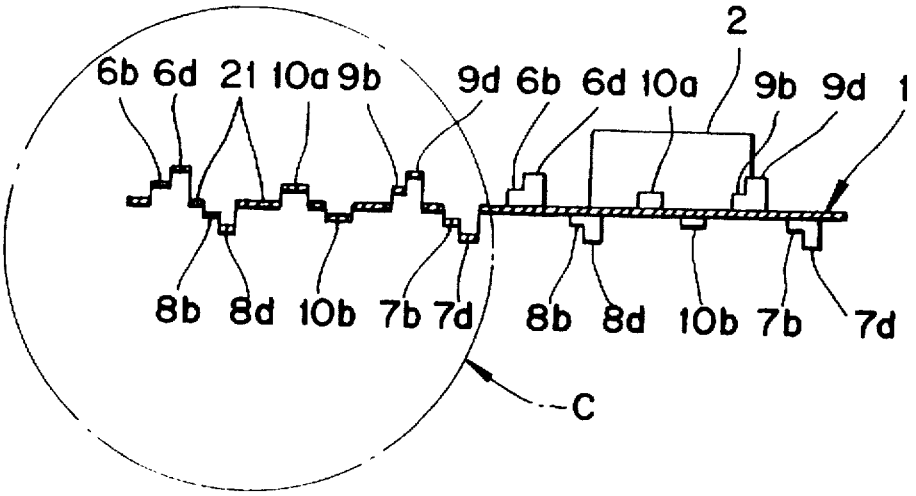
FIG. 6 is a sectional view seen along 6—6 line in FIG. 5.

The heat exchanger according to the present invention includes, as illustrated in FIG. 5, a plurality of flat fins 1 arranged in parallel at predetermined intervals, a plurality of heat transfer pipes 2 arranged perpendicular to the plurality of flat fins in zigzag patterns so that heat exchange can be realized between the passing fluid and medium conducted therethrough, and two-tier slit type grid groups 20 formed in the flat fins 1 whereby the slits are tapered to become wider in a direction away from the pipes, and the slits extend generally radially (radiantly) with respect to the pipes.

At this location, the two-tier slit type grid groups 20 have respective predetermined bases (i.e., non-slit parts) 21 between the slits. Each group has a criss-crossed shape & possesses slits projecting from both sides of the flat fins 1.

In other words, the two-tier slit-type grid groups 20 includes (i) first and second generally vertical slit units 6*a* and 6*b* respectively formed at predetermined intervals and at predetermined slants relative to vertical in symmetrical shapes in the flat fins 1, so that the fluid can pass through the fin at a front end section of the heat transfer pipe 2 to thereafter become turbulent (ii) third and fourth generally vertical slit units 7*a* and 7*b* respectively formed at predetermined intervals and predetermined slants relative to vertical in symmetrical shapes in the flat fins 1 and at the same time in symmetrical shape relative to the first and second slit units 6*a* and 6*b*, so that the fluid can pass through the fin at a rear end section of the heat transfer pipe 2 to thereafter become turbulent (iii) fifth and sixth generally vertical slit units 8*a* and 8*b* respectively formed at predetermined intervals and at predetermined slants relative to vertical in symmetrical in the flat fins 1 behind the first and second slit units 6*a* and 6*b*, so that the fluid can become turbulent at the front end section of the heat transfer pipes 2 (iv) seventh and eighth generally vertical slit units 9*a* and 9*b* respectively formed at predetermined intervals and at predetermined slants relative to vertical in symmetrical shapes in the flat fins 1 in front of the third and fourth slit units 7*a* and 7*b* so that the fluid can become turbulent at the rear end section of the heat transfer pipes 2, and (v) ninth and tenth slit units 10*a* and 10*b* and vertically formed at predetermined intervals between the fifth and sixth slit units 8*a* and 8*b* and the seventh and the eighth slit units 9*a* and 9*b* so that turbulent fluid can be mixed to thereby reduce the void generated in the back of the heat transfer pipes 2.

Each slit of the two arrays includes inner and outer ends I, O respectively disposed proximately and remotely relative to the associated pipe 2. The inner end I is spaced from its respective pipe by a solid, non-slit portion P of the fin. The outer end O is spaced from an outer end of a slit of the other array by a solid, non-slit portion P of the fin. Each of the slits 10*a*, 10*b* constitutes a transverse slit which extends perpendicularly relative to a flow direction of fluid along the fin.

Furthermore, the slit units 6*a*, 6*b*, 7*a*, 7*b*, 8*a*, 8*b*, 9*a* and 9*b* are protrudingly and outwardly formed at respective proximities thereof with auxiliary slit units 6*c*, 6*d*, 7*c*, 7*d*, 8*c*, 8*d*, 9*c* and 9*d* which extend farther from the main plane of the fin than the slit units 6*a*, 6*b*, 7*a*, 7*b*, 8*a*, 8*b*, 9*a* and 9*b*, respectively At this location, the interval between the first slit unit 6*a* and the second slit unit 6*b*, and the interval between the third slit unit 7*a* and the fourth slit unit 7*b* are respectively formed larger than the interval between the fifth slit unit 8*a* and the sixth slit unit 8*b* and the interval between the seventh slit unit 9*a* and the eighth slit unit 9*b*.

The sectional areas of the first, second, third and fourth slit units 6*a*, 6*b*, 7*a* and 7*b* are respectively formed larger than those of the fifth, sixth, seventh and eighth slit units 8*a*, 8*b*, 9*a* and 9*b*.

Figure 7:
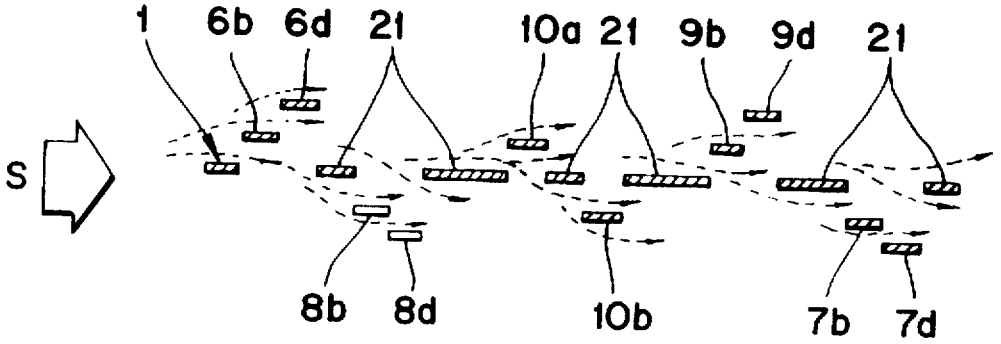
FIG. 7 is a sectional view for illustrating flow of air current by enlarging portion C in FIG. 6.

Furthermore, the first, second, seventh, eighth and ninth slit units 6*a*, 6*b*, 9*b* and 10*a*, are protrudingly formed at predetermined intervals toward one side of the flat fin 1 as a result of cutting process as is evident from FIG. 7, and the third, fourth, fifth, sixth and tenth slit units 7*a*, 7*b*, 8*a*, 8*b* and 10*b* are protrudingly and mutually alternatively formed at predetermined intervals among the first, second, seventh, eighth and ninth slit units 6*a*, 6*b*, 9*a*, 9*b* and 10*a* toward the other side of the flat fin 1 by way of cutting process.

The ninth and tenth slit units 10*a* and 10*b* are formed between the fifth and sixth slit units 8*a* and 8*b* and the seventh and eighth slit units 9*a* and 9*b* in the light of flow of the fluid.

A distance D between the upstream-most slits 6*a*, 6*b* of upper and lower tiers, respectively, of each group, is larger than a distance D' between the next slits 8*a*, 8*b* of the upper and lower tiers. Also, the distance d between the downstream-most slits 7*a*, 7*b* is larger than the distance d' between the slits 9*a*, 9*b* located immediately upstream of the downstream-most slits 7*a*, 7*b*.

Next, the operation of the heat exchanger of an air conditioner thus constructed will be described.

When the fluid flows in an arrow head direction S illustrated in FIG. 7, between the flat fins 1, which define heat exchange regions, the fluid passes through guide passages formed by the slit units 6*a*, 6*b*, 7*a*, 7*b*, 8*a*, 8*b*, 9*a* and 9*b* of the two-tier slit type grid groups 20, to thereby be rendered turbulent. The fluid also passes through the auxiliary slit unit 6*c*, 6*d*, 7*c*, 7*d*, 8*c*, 8*d*, 9*c* and 9*d* respectively formed at the rear portions of the slit units 6*a*, 6*b*, 7*a*, 7*b*, 8*a*, 8*b*, 9*a* and 9*b* and becomes turbulent.

In other words, the fluid is dispersed while passing through the heat exchange regions.

When, the fluid passes through the ninth and tenth slit units 10*a* and 10*b*, it becomes divided into two directions and is merged again to thereby form a mixed air current, so that the void formed at the back of the heat transfer pipes 2 can be minimized in size.

At this time, an external surface of the heat transfer pipe 2 is always in touch with new fluid according to turbulence and mixture of the fluid, and as a result, an optimum heat transfer is realized between the fluid at an external side of the heat transfer pipe 2 and the medium in an inner side of the heat transfer pipe 2.

In other words, the first, second, seventh, eighth and ninth slit units 6*a*, 6*b*, 9*a*, 9*b* and 10*a* of the two-tier slit type grid groups 20 and the auxiliary slit units 6*c*, 6*d*, 9*c* and 9*d* are protrudingly formed at the other side surface of the flat fins 1 in mutually alternative diagonal shapes, with the third, fourth, fifth, sixth and the tenth 7*a*, 7*b*, 8*a*, 8*b* and 10*b* slit units and the auxiliary slit units 8*c*, 8*d*, 7*c* and 7*d* protrudingly formed at one side surface of the flat fins 1, so that efficiency of heat exchange can be improved because the slit units 6*a*, 6*b*, 9*a*, 9*b* and 10*a* and the auxiliary slit units 6*c*, 6*d*, 9*c* and 9*d* are not included in the temperature boundary layer (the region where the heat from the heat transfer pipes is not properly transferred) formed by the slit units 7, 7*b*, 8*a*, 8*b* and 10*b* from the standpoint of fluid flow.

Furthermore, the slit units 6*a*, 6*b*, 7*a*, 7*b*, 8*a*, 8*b*, 9*a*, 9*b*, 10*a* and 10*b* and auxiliary slit units 6*c*, 6*d*, 7*c*, 7*d*, 8*c*, 8*d*, 9*c* and 9*d* extend generally radially with reference to an adjacent heat transfer pipe 2, so that the fluid can become turbulent and dispersed it its flow to markedly reduce the unavoidable void generated in the back of the heat transfer pipes 2.

Still furthermore, the slit units 6*a*, 6*b*, 7*a*, 7*b*, 8*a*, 8*b*, 9*a* and 9*b* and the auxiliary slit units 6*c*, 6*d*, 7*c*, 7*d*, 8*c*, 8*d*, 9*c* and 9*d* are tapered off whereby sectional areas thereof to become larger as the same is distanced from the heat transfer pipe 2, so that heat exchange efficiency can be improved even in the spaces formed farthest from the heat transfer pipes 2 where the heat exchange phenomenon is least realized.

As is apparent from the foregoing, there is an advantage in the heat exchanger of an air conditioner according to the present invention in that two-tier slit type grid groups have the slits arranged in radiating (generally radially projecting) form around heat transfer pipes and at the same time have sectional areas becoming larger with increasing distance from the heat transfer pipes, and the two-tier slit type grid groups extend up the flat fins in a zigzag pattern, so that turbulence of the fluid is facilitated to thereby minimize the unavoidable void generated in the back of the heat transfer pipes and to increase heat exchange efficiency.

What is claimed is:

1. A heat exchanger of an air conditioner comprising generally flat fins arranged in parallel to conduct fluid therebetween in a flow direction, and heat transfer pipes extending through the flat fins and arranged in a zig-zag pattern; each fin including a plurality of slits; the slits arranged in groups, each group disposed between first and second adjacent pipes, the adjacent pipes spaced apart in a transverse direction extending transversely of the flow direction; each group of slits including a first tier of slits, each slit of the first tier arranged generally radially with respect to the first pipe and a second tier of slits each slit of which being arranged generally radially with respect to the second pipe; each slit of the first and second tiers including inner and outer ends, the first end disposed proximate the respective pipe and spaced therefrom by a solid non-slit portion of the fin; the outer ends of the slits in the first tier opposing the outer ends of respective slits of the second tier and spaced therefrom in the transverse direction by a solid non-slit portion of the fin; there being only two tiers of slits in each group of slits; a plurality of the slits of each tier protecting from one side of the fin, and another plurality of the slits of each tier projecting from an opposite side of the fin.

2. The heat exchanger according to claim 1, wherein each of the first and second tiers includes four slits; each group of slits further including a pair of transverse slits extending perpendicularly to the flow direction, a first portion of each perpendicular slit disposed between two slits of the first tier, and a second portion of each transverse slit disposed between two slits of the second tier.

3. The heat exchanger according to claim 2, wherein each of said four slits of each tier is formed by a pair of bent-out portions of the fin, one of the bent-out portions of each pair extending farther from a main plane of the fin than the other bent out portion of the pair.

4. The heat exchanger according to claim 2, wherein two of the four slits of each tier are formed by portions of the fin bent-out from one side of the fin, and the other two of the four slits of each tier are formed by portions of the fin bent out from the other side of the fin.

5. The heat exchanger according to claim 2, wherein an upstream-most slit of the first tier is spaced transversely from an upstream-most slit of the second tier by a first distance; and a slit located immediately downstream of the upstream-most slit of the first tier is spaced by a second transverse distance from a slit located immediately downstream of the upstream-most slit of the second tier; the first distance being greater than the second distance.

6. The heat exchanger according to claim 5 wherein a downstream-most slit of the first tier is spaced transversely from a downstream-most slit of the second tier by a first distance; a slit of the first tier located immediately upstream of the downstream-most slit thereof being spaced by a second transverse distance from a slit of the second tier located immediately upstream of the downstream-most slit of the second tier; the first distance being greater than the second distance.

* * * * *